US010271658B2

(12) United States Patent
Lange

(10) Patent No.: US 10,271,658 B2
(45) Date of Patent: Apr. 30, 2019

(54) NECK REST WITH A HOLDING MECHANISM

(71) Applicant: LASCH HOLDING APS, Skodsborg (DK)

(72) Inventor: Jesper J. Lange, Skodsborg (DK)

(73) Assignee: LASCH HOLDING APS, Skodsborg (DK)

( * ) Notice: Subject to any disclaimer, the term of this patent is extended or adjusted under 35 U.S.C. 154(b) by 329 days.

(21) Appl. No.: 15/036,991

(22) PCT Filed: Nov. 13, 2014

(86) PCT No.: PCT/EP2014/074505

§ 371 (c)(1),
(2) Date: May 16, 2016

(87) PCT Pub. No.: WO2015/074947

PCT Pub. Date: May 28, 2015

(65) Prior Publication Data

US 2016/0286964 A1 Oct. 6, 2016

(30) Foreign Application Priority Data

Nov. 20, 2013 (DK) ..... 2013 70710

(51) Int. Cl.
*A47C 7/38* (2006.01)
*A47C 16/00* (2006.01)
*A47G 9/10* (2006.01)

(52) U.S. Cl.
CPC ..... *A47C 7/383* (2013.01); *A47C 16/00* (2013.01); *A47G 9/1081* (2013.01)

(58) Field of Classification Search
CPC .. A47C 7/383; A47C 7/38; A47C 7/36; A47C 7/40; A47C 7/407; A47C 7/42; A47C 7/465; A47C 7/46; A47C 16/00; A47G 9/10; A47G 9/1027; A47G 9/1036; A47G 9/1045; A47G 9/1054; A47G 9/1063; A47G 9/1072; A47G 9/1081; A47G 9/109
USPC ..... D6/716.4, 716.5, 601
See application file for complete search history.

(56) References Cited

U.S. PATENT DOCUMENTS 808,217 A 12/1905 Reich
4,738,488 A 4/1988 Camelio
5,190,347 A * 3/1993 Shiow-Lan ..... A47C 7/425 297/230.11

(Continued)

OTHER PUBLICATIONS

International Search Report and Written Opinion from International Application No. PCT/EP2014/074505, dated Jan. 15, 2015, 7 pages.

*Primary Examiner* — Eric J Kurilla
*Assistant Examiner* — Amanda L Bailey
(74) *Attorney, Agent, or Firm* — Merchant & Gould P.C.

(57) ABSTRACT

A neck rest for supporting the neck and head of a human being, comprising a right and a left elongate support member, and a collapsible intermediate section interconnecting the support members. The support members and the intermediate section are sufficiently bendable to conform to the natural contour of the left and right neck and head portions of the human being. The neck rest further comprises a holding mechanism for maintaining the support members in bent position. The holding mechanism may be adapted to be in a locked state and in a released state.

4 Claims, 2 Drawing Sheets

(56) References Cited

U.S. PATENT DOCUMENTS

| | | | | |
|---|---|---|---|---|
| 7,908,692 | B2 | 3/2011 | Lange | |
| 2009/0211032 | A1 * | 8/2009 | Lange | A47C 7/383<br>5/652 |

* cited by examiner

NECK REST WITH A HOLDING MECHANISM

This application is a National Stage Application of International Application No. PCT/EP2014/074505, filed 13 Nov. 2014, which claims benefit of Serial No. PA 2013 70710, filed 20 Nov. 2013 in Denmark and which applications are incorporated herein by reference. To the extent appropriate, a claim of priority is made to each of the above disclosed applications.

FIELD OF THE INVENTION

The present invention relates to a neck rest for supporting the neck and head of a human being, e.g. for supporting the neck and head of the human being when resting in a high-backed seat, in a bed, on a sunbed or on a hard surface.

BACKGROUND OF THE INVENTION

Various cushions and travel pillows have been proposed in the prior art to address the problems of supporting a human being's neck and head while resting in a seat during traveling.

For example U.S. Pat. No. 7,908,692 discloses a support for the neck and head of a human being, comprising a right and a left elongate support member, and a collapsible intermediate section interconnecting the right and left support members. The support members are adapted to extend in the human being's cranial-caudal direction and to support a right and a left portion of the back head and neck. Each of the support members and the intermediate section is sufficiently bendable to conform to the natural contour of the left and right neck and head portions of the human being. However, as soon as the neck and head of the human being no longer apply a force to the support members, the support members will restore their natural, elongated shapes, and the human being will have to rearrange the support members in order to restore the support of the head and neck.

DESCRIPTION OF THE INVENTION

It is an object of embodiments of the invention to provide a neck rest in which a desired shape, such as a desired bending, of the support members can be maintained.

The invention provides a neck rest for supporting the neck and head of a human being, comprising a right and a left elongate support member, wherein:

- the neck rest further comprises a collapsible intermediate section interconnecting the right and left support members,
- the support members are adapted to extend in the human being's cranial-caudal direction and to support a right and a left portion of the back head and neck,
- the neck rest is dimensioned to extend only behind the human being's ears, with no portion of the neck rest supporting or touching the human being's cheeks or jaws during use,
- the support members are incompressible under the weight of the head of a human being,
- at transitions between the intermediate section and the support members, the support members define left and right edges for engaging the human being's neck and mastoid bones behind the human being's ears to provide a support for the human being's head when the neck rest is under pressure from the human being's head and neck,

- each of the support members and the intermediate section is sufficiently bendable to conform to the natural contour of the left and right neck and head portions of the human being, and
- the material characteristics of each of the support members are such that the support members provide a biasing force on the human being's occipital and mastoid bones during use of the neck rest, characterized in that the neck rest further comprises a holding mechanism for maintaining the support members in a bent position.

In the neck rest of the invention the neck and head of a human being are supported in such a way that they rest in a fixed, natural position allowing the human being's muscles and in particular the spine to relax. Furthermore, the head may rest not only in a forwardly-facing straight position, but also in various sideward turned and tilted positions to avoid pain occurring when the head is held in the same position for a longer period of time.

The elongate support members provide a two-directional support of the back head, i.e. a support in a sideways direction and a support in an upwards direction. Preferably, the support members extend in the entire length from immediately above the human being's shoulders to the occipital ridge following the specific contour of the left and right neck and head portions of the human being.

Since the support members are incompressible under the weight of the head of a human being, the support provided by the support members is a stable support, i.e. a firm support. Furthermore, each of the support members and the intermediate section is sufficiently bendable, and possibly also yielding, to conform to the natural contour of the left and right neck and head portions of the human being. Thereby the bent support members provide good support for the head and neck of a human being using the neck rest, regardless of the exact anatomy of that specific human being.

The support members may be made from a flexible but yet rigid foam, e.g. a closed cell foam, or from sheets of fabric, e.g. cotton, rolled up to form cylinders, bags stuffed with such materials or fabrics, felt rolls, etc.

The intermediate section is preferably arranged to draw the support members against each other when the head and neck of the human being rest against the intermediate section causing the support members to adapt to the natural contour of the left and right neck and head portions of the human being.

The physical properties of the neck rest are preferably such that, when it is placed between the human being and a fixed support surface in a bent configuration to conform to the natural contour of the neck and head of the human being, the neck rest provides a pressure on the occipital and mastoid bones of the head and the back top of the shoulders of the human being in the cranial-caudal direction. Such a pressure may derive from the material characteristics of the material of the elongate support members, i.e. from a biasing force or spring force provided by the elongate support members.

Preferably, the support members and the intermediate section are bendable in their entire lengths to at least 90 degrees in more than one direction to conform to the natural contour of the left and right neck and head portions of various sizes of the human being.

The neck rest further comprises a holding mechanism for maintaining the support members in a bent position.

Thus, the bending of the support members can be maintained by means of the holding mechanism for as long as desired, and it is not necessary to rearrange the support members in the case that the head of the human being is moved in such a manner that the neck and head of the human being no longer apply a force to the support members, which is sufficient to hold them in a bent position, purely by means of the force applied by the neck and head of the human being.

The holding mechanism may be a mechanical mechanism. For instance, the holding mechanism may comprise a bendable and shape preserving member arranged inside each of the support members. Such a bendable and shape preserving member could, e.g., be in the form of a wire or a bendable, elongated metal rod, which can be bent to a desired bending, and which maintains this bending until the bending is manually changed. As an alternative, the holding mechanism may be in the form of a fabric enclosing the support members, the fabric being sewn into a specific shape, which substantially corresponds to the shape of the head and neck of a human being. In this case, the support members may be bent during manufacturing and positioned inside the fabric. The specific shape of the fabric then ensures that the support members are maintained in the bent position. In this case the support members should be made from a material which is sufficiently yielding to allow them to the conform to the natural contour of neck and head portions of a specific human being. Alternative examples of holding mechanisms are described below.

The holding mechanism may be adapted to be in a locked state and in a released state. In the locked state, the holding mechanism maintains a selected bending of the support members. In the released state the support members are allowed to restore a non-bent shape. Thus, while the holding mechanism is in the released state, the support members can be bent to reach a desired bending which matches the contours of the neck and head of a specific human being, thereby conforming to the anatomy of that specific human being, and being capable of providing good support for the neck and head of that human being. Once the support members have been bent to this position, the holding mechanism can be moved to the locked state, and thereby the selected bending of the support members is maintained until the holding mechanism is once again moved to the released state. Thus, in this case the desired bending is maintained by means of the holding mechanism being in the locked state.

The holding mechanism may comprise at least one strap arranged along each of the support members, and at least one releasable locking member mounted on each strap, and being adapted to releasably hold the strap(s) in a selected position. According to this embodiment, the holding mechanism will typically be in the locked state when at least one locking member holds at least one strap in a selected position. Similarly, the holding mechanism will typically be in the released state when the locking member(s) is/are not holding the strap(s) in a selected position. Preferably, the selected position determines the bending of the support members.

The support members may be fixedly attached to the intermediate section. Thereby it is prevented that the support members are drawn into or towards the intermediate section when the strap(s) is/are tightened. Accordingly, a desired bent position of the support members is achieved.

The strap(s) may be arranged exterior relative to the support members, i.e. they may extend along outer surfaces of the support members. In this case the strap(s) may extend along a longitudinal direction defined by the support members, or it/they may extend diagonally across the intermediate section, thereby interconnecting the two support members. As an alternative, one or more straps may be arranged inside a support member. In this case a desired bending of a support member may be obtained by pulling the strap arranged inside the support member in such a manner that the length of the part of the strap arranged inside the support member becomes smaller than the length of the support member. In this case the locking member may advantageously prevent the strap from re-entering the support member, when the locking member is in its locking position.

Each releasable locking member may be adapted to squeeze a portion of the corresponding strap, thereby preventing movements of the strap relative to the locking member, when the locking member is in a locking position, and the strap may be allowed to move relative to the locking member when the locking member is in a released position. According to this embodiment, when the locking member is in the released position, and the strap is therefore allowed to move relative to the locking member, the relative position of the strap and the locking member can be adjusted until a desired bending of the support member is obtained. The locking member may then be moved to the locking position, thereby squeezing a portion of the strap being arranged at the locking member and preventing further relative movements of the strap and the locking member. Accordingly, the strap and the locking member are maintained in this relative position, and the strap and the locking member cooperate in maintaining the bending of the support member.

Each locking member may comprise a biasing mechanism biasing the locking member towards its locking position. According to this embodiment, the locking member will be in the locking position unless a force is applied against the biasing force of the biasing mechanism, e.g. by pushing or squeezing the locking member using the fingers, in order to move the locking member to the released position. Thus, the locking member must be actively operated in order to move the locking member to the released position, where it is possible to set the desired bending of the support members, and when a force is no longer applied to the locking member, it is automatically moved to the locking position, and the selected bending of the support members is maintained. The biasing mechanism may, e.g., comprise a compressible spring.

According to one embodiment, each strap may be fixed to one of the support members at a first position, and may pass through a noose arranged at a second position at the support member, and the position of the corresponding locking member, in its locking position, on the strap may define a distance between the first position and the second position, along the strap, the locking member thereby maintaining the support member in a bent position, defined by a difference between the distance between the first position and the second position along the support member, and the distance between the first position and the second position along the strap. When the strap is pulled through the noose in a direction away from the first position, the noose is pulled towards the first position when the length of the part of the strap which extends between the first position and the part which is arranged in the noose becomes smaller than the distance between the first position and the second position, along the support member. This will cause the support member to bend increasingly. The locking member may be arranged in such a manner that it abuts the noose, thereby maintaining an obtained bending of the support member, when the locking member is moved to the locking position.

According to an alternative embodiment, each strap may form a loop which passes through a first noose arranged at a first position at one of the support members, and which passes through a second noose arranged at a second position at the support member, and the position of the corresponding locking member, in its locking position, on the strap may define a distance between the first position and the second position, along the strap, the locking member thereby maintaining the support member in a bent position, defined by a difference between the distance between the first position and the second position along the support member, and the distance between the first position and the second position along the strap. When the locking member is moved relative to the loop formed strap, the first and second noose are pulled towards each other, because the circumference of the loop formed by the strap is decreased. This will cause the support member to bend increasingly. When the locking member is moved to the locking position, it squeezes the strap in such a manner that the obtained circumference of the loop formed by the strap, and thereby the obtained bending of the support member, is maintained.

The support members may be fixedly attached to the intermediate section. According to this embodiment, transitions between the support members and the intermediate section closely follow the shape of the support members when these are bent. The support members are prevented from bending into the region defined by the intermediate section, and thereby a desired contour of the neck rest is obtained when the support members are moved into the bent position. For instance, pockets may be formed on opposite sides of the intermediate section, and material forming the support members may be filled directly into the pockets.

As an alternative, the support members may be separate members being detachably attached to the intermediate section. For instance, the support members may be in the form of removable rods arranged in pockets formed on opposite sides of the intermediate section.

BRIEF DESCRIPTION OF THE DRAWINGS

The invention will now be described in further detail with reference to the accompanying drawings in which.

DETAILED DESCRIPTION OF THE DRAWINGS

Figure 1:
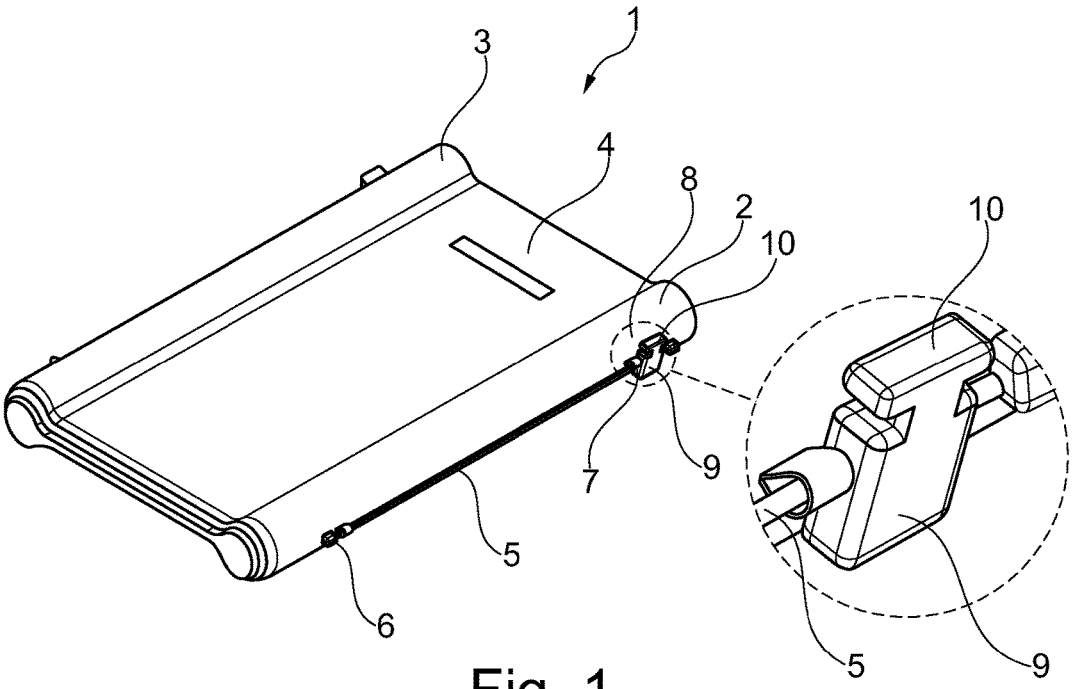
FIG. 1 is a perspective view of a neck rest according to a first embodiment of the invention, in a non-bent position.

FIG. 1 is a perspective view of a neck rest 1 according to a first embodiment of the invention.

The neck rest 1 comprises a right elongate support member 2 and a left elongate support member 3, and a collapsible intermediate section 4 interconnecting the right support member 2 and the left support member 3, and arranged to control the maximum transverse distance between the support members 2, 3.

The dimensions of the support members 2, 3 are such that the head and neck of a human being are at least partly secured in a transverse direction between the support members 2, 3 when the head and neck rest against the neck rest 1 and when the support members 2, 3 extend in the human being's cranial-caudal direction with a left and right portion of the human being's back head resting against one or both of the support members 2, 3. The support members 2, 3 preferably have a length sufficient to allow them to extend from a position immediately above the human being's shoulders up to at least occipital ridge behind the ears following the specific natural contour of the left and right neck and head portions of the human being. Hence, the length of the support members 2, 3 is in the range of 7-20 cm for infants, and 12-40 cm for adults. The diameter of the support members 2, 3 is preferable within the range of 0.5-5 cm, preferably 2-3 cm. The width of the neck rest 1 is not much wider than the width of the back head of a human being, e.g. 8-20 cm for adults or 4-15 cm for infants.

Preferably, the measurements of the neck rest 1 do not exceed 20 cm (width)×40 cm (length)×5 cm (depth).

The intermediate section 4 may have a thickness of at most 2 cm, such as at most 1.5 cm when the intermediate section 4 is under pressure from the head and neck of a human being. In order to reduce the space occupied by the neck rest 1, it may be preferable that the intermediate section 4 is as thin as possible.

The support members 2, 3 are made from a flexible but yet rigid foam, e.g. a closed-cell foam. Thereby the support members 2, 3 provide stable support for the head and neck of the human being, and the support members 2, 3 are sufficiently bendable to conform to the natural contour of the left and right neck and head portions of the human being.

A holding mechanism is provided along each of the support members 2, 3. Only one of the holding mechanisms is visible in FIG. 1. The holding mechanism comprises a strap 5 which is fixedly attached to the support member 2 at a first position 6. The strap 5 passes through a noose 7 arranged at a second position 8 at the support member 2.

The strap 5 further passes through a locking member 9 which is arranged on the strap 5 in such a manner that the noose 7 is arranged between the first position 6, where the strap 5 is fixed to the support member 2, and the locking member 9. The locking member 9 is shown in detail in the enlarged portion of FIG. 1.

The locking member 9 is biased towards a locking position, where it squeezes the part of the strap 5 which is arranged inside the locking member 9. However, by pushing knob 10 the locking member 9 can be moved into a released position, where the strap 5 is allowed to move relative to the locking member 9. Thereby the length of the part of the strap 5 being arranged between the first position 6 and the noose 7/second position 8 can be adjusted.

In FIG. 1 the neck rest 1 is shown in a non-bent position, i.e. the support members 2, 3 have their natural, straight shape, and no force is applied to the support members 2, 3. When it is desired to use the neck rest 1, the knob 10 is pushed, thereby moving the locking member 9 to the released position. Then the strap 5 is pulled through the noose 7 and the locking member 9, in a direction away from the first position 6. Thereby the length of the part of the strap 5 being arranged between the first position 6 and the noose 7/second position 8 is decreased, resulting in the support member 2 being bent. When a desired bending of the support member 2 has been obtained, the locking member 9 is moved to the locking position by letting go of the knob 10. Thereby the locking member 9 squeezes the strap 5 and prevents it from moving back through the noose 7. Accordingly, the bending of the support member 2 is maintained by the strap 5 and the locking member 9. The process described above is also performed with respect to the left support member 3.

The support members 2, 3 may be bent to obtain the desired bending before the neck rest 1 is arranged behind the head and neck of the human being. As an alternative, the neck rest 1 may be arranged behind the head and neck of the human being before the support members 2, 3 are fixed in a bent position, the bending of the support members 2, 3 thereby being obtained while the neck rest 1 is arranged against the head and neck of the human being. Thereby a suitable bending of the support members 2, 3 can easily be provided.

Thus, a desired bending of the support members 2, 3 is maintained by means of the strap 5 and the locking member 9, even if the neck and head of the human being no longer apply a force to the support members 2, 3. Thereby it is not necessary to rearrange the support members 2, 3 and to restore a desired bending of the support members 2, 3 if this should occur.

Figure 2:
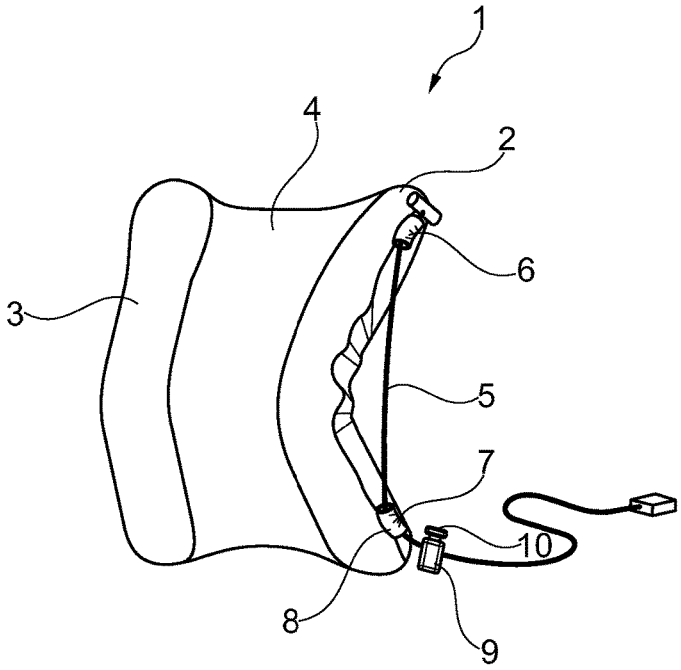
FIG. 2 is a perspective view of the neck rest of FIG. 1 in a bent position.

FIG. 2 is a perspective view of the neck rest 1 of FIG. 1 in a bent position. It can be seen how the strap 5 and the locking member 9 cooperate in maintaining the obtained bending of the support member 2.

Figure 3:
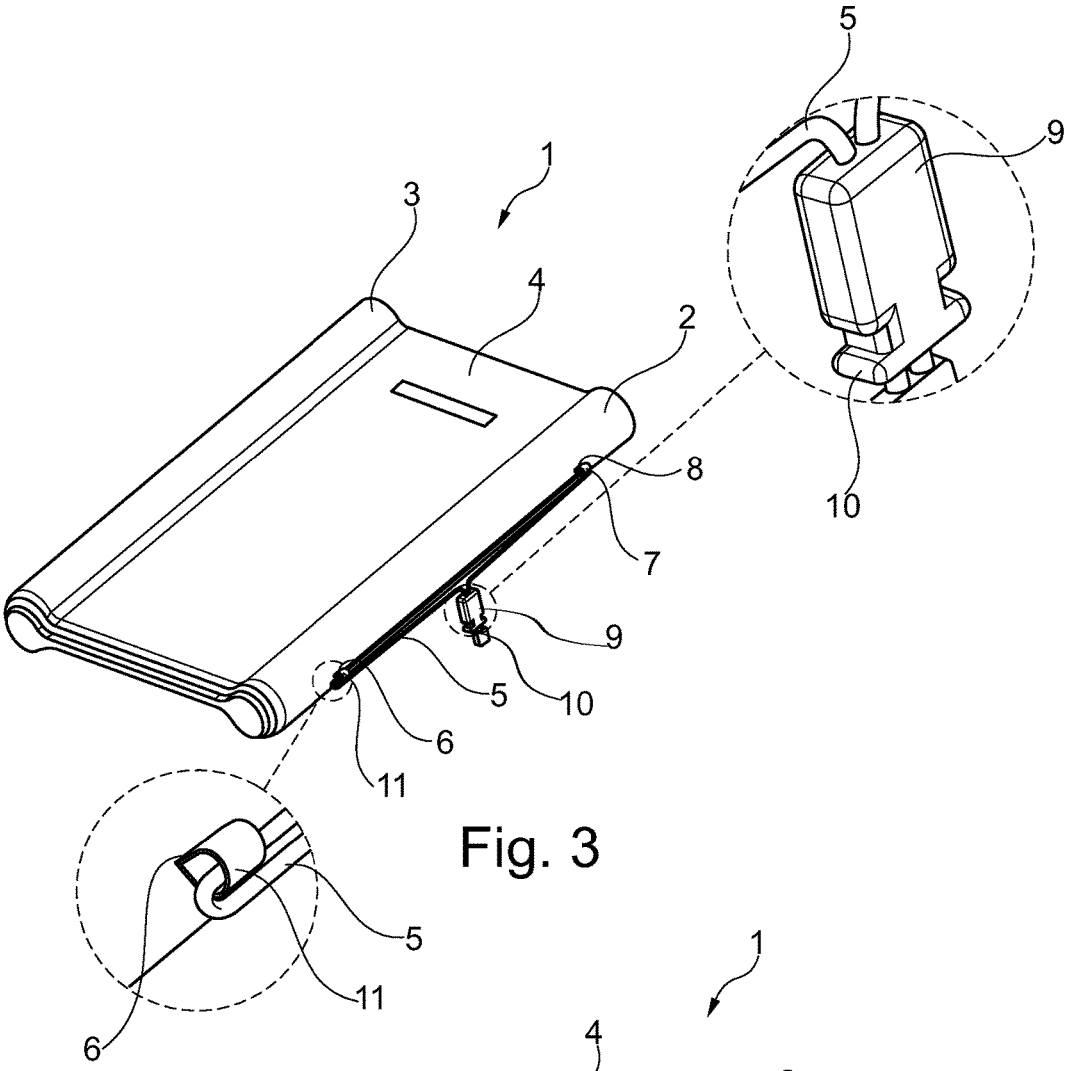
FIG. 3 is a perspective view of a neck rest according to a second embodiment of the invention, in a non-bent position.

FIG. 3 is a perspective view of a neck rest 1 according to a second embodiment of the invention. The neck rest 1 of FIG. 3 is very similar to the neck rest 1 of FIG. 1, and it will therefore not be described in further detail.

The neck rest 1 of FIG. 3 is also provided with a holding mechanism along each of the support members 2, 3. Only one of the holding mechanisms is visible in FIG. 3. The holding mechanism comprises a strap 5 which forms a loop. The strap 5 passes through a first noose 11 arranged at a first position at the support member 2, and through a second noose 7 arranged at a second position 8 at the support member 2.

The strap 5 further passes through a locking member 9 in such a manner that the relative position of the locking member 9 and the strap 5 defines a circumference of the loop formed by the strap 5. The enlarged portions of FIG. 3 show the first noose 11 and the locking member 9, respectively, in detail.

The locking member 9 is biased towards a locking position, where it squeezes the part of the strap 5 which is arranged inside the locking member 9. However, by pushing knob 10 the locking member 9 can be moved into a released position, where the strap 5 is allowed to move relative to the locking member 9. Thereby the circumference of the loop formed by the strap 5 can be adjusted.

In FIG. 3 the neck rest 1 is shown in a non-bent position, i.e. the support members 2, 3 have their natural, straight shape, and no force is applied to the support members 2, 3. When it is desired to use the neck rest 1, the knob 10 is pushed, thereby moving the locking member 9 to the released position. The strap 5 is then pulled through the locking member 9, in a direction away from the support member 2. Thereby the circumference of the loop formed by the strap 5 is decreased, resulting in the first position 6 and the second position 8 being pulled towards each other, due to the strap 5 passing through the nooses 7, 11. As a consequence, the support member 2 is bent. When a desired bending of the support member 2 has been obtained, the locking member 9 is moved to the locking position by letting go of the knob 10. Thereby the locking member 9 squeezes the strap 5 and prevents it from moving back through the locking member 9. Accordingly, the decreased circumference of the loop formed by the strap 5 is maintained, and thereby the obtained bending of the support member 2 is also maintained by the strap 5 and the locking member 9. The process described above is also performed with respect to the left support member 3.

The support members 2, 3 may be bent to obtain the desired bending before the neck rest 1 is arranged behind the head and neck of the human being. As an alternative, the neck rest 1 may be arranged behind the head and neck of the human being before the support members 2, 3 are fixed in a bent position, the bending of the support members 2, 3 thereby being obtained while the neck rest 1 is arranged against the head and neck of the human being. Thereby a suitable bending of the support members 2, 3 can easily be provided.

Thus, a desired bending of the support members 2, 3 is maintained by means of the strap 5 and the locking member 9, even if the neck and head of the human being no longer apply a force to the support members 2, 3. Thereby it is not necessary to rearrange the support members 2, 3 and to restore a desired bending of the support members 2, 3 if this should occur.

Figure 4:
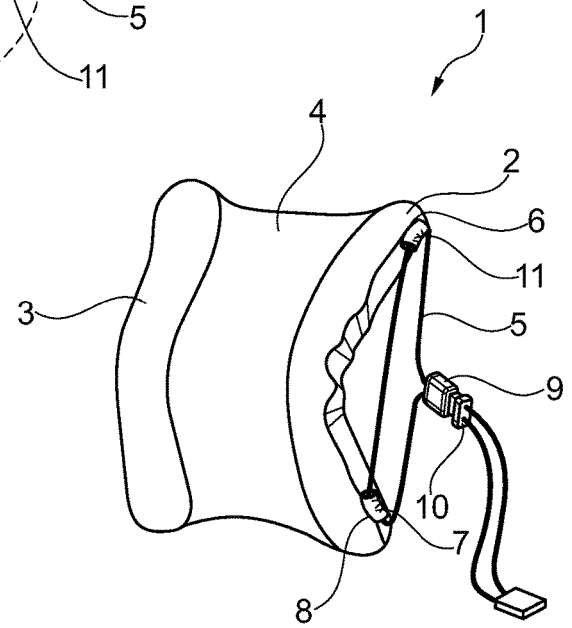
FIG. 4 is a perspective view of the neck rest of FIG. 3 in a bent position.

FIG. 4 is a perspective view of the neck rest 1 of FIG. 3 in a bent position. It can be seen how the strap 5 and the locking member 9 cooperate in maintaining the obtained bending of the support member 2.

The invention claimed is:

1. A neck rest for supporting the neck and head of a human being, comprising a right and a left elongate support member, wherein:

the neck rest further comprises a collapsible intermediate section interconnecting the right and left support members, the support members are adapted to extend in the human being's cranial-caudal direction and to support a right and a left portion of the back head and neck, the neck rest is dimensioned to extend only behind the human being's ears, with no portion of the neck rest supporting or touching the human being's cheeks or jaws during use, the support members are incompressible under the weight of the head of a human being, at transitions between the intermediate section and the support members, the support members define left and right edges for engaging the human being's neck and mastoid bones behind the human being's ears to provide a support for the human being's head when the neck rest is under pressure from the human being's head and neck, each of the support members and the intermediate section is sufficiently bendable to conform to the natural contour of the left and right neck and head portions of the human being, and the material characteristics of each of the support members are such that the support members provide a biasing force on the human being's occipital and mastoid bones during use of the neck rest, wherein the neck rest further comprises a holding mechanism for maintaining the support members in a bent position, the holding mechanism being adapted to be in a locked state, in which a selected bending of the support members is maintained, and in a released state, in which the support members are allowed to restore a non-bent shape, wherein the holding mechanism comprises at least one strap arranged along each of the support members, and at least one releasable locking member mounted on each strap, and being adapted to releasably hold the strap(s) in a selected position, wherein each releasable locking member is adapted to squeeze a portion of the corresponding strap, thereby preventing movements of the strap relative to the locking member, when the locking member is in a locking position, wherein the strap is allowed to move relative to the locking member when the locking member is in a released position, wherein each locking member comprises a biasing mechanism biasing the locking member towards its locking position, wherein each strap is fixed to one of the support members at a first position, and passes through a noose arranged at a second position at the support member, and wherein the position of the corresponding locking member, in its locking position, on the strap defines a distance between the first position and the second position, along the strap, the locking member thereby maintaining the support member in a bent position, defined by a difference between the distance between the first position and the second position along the support member, and the distance between the first position and the second position along the strap.

2. A neck rest according to claim 1, wherein the support members are fixedly attached to the intermediate section.

3. A neck rest for supporting the neck and head of a human being, comprising a right and a left elongate support member, wherein:

the neck rest further comprises a collapsible intermediate section interconnecting the right and left support members, the support members are adapted to extend in the human being's cranial-caudal direction and to support a right and a left portion of the back head and neck, the neck rest is dimensioned to extend only behind the human being's ears, with no portion of the neck rest supporting or touching the human being's cheeks or jaws during use, the support members are incompressible under the weight of the head of a human being, at transitions between the intermediate section and the support members, the support members define left and right edges for engaging the human being's neck and mastoid bones behind the human being's ears to provide a support for the human being's head when the neck rest is under pressure from the human being's head and neck, each of the support members and the intermediate section is sufficiently bendable to conform to the natural contour of the left and right neck and head portions of the human being, and the material characteristics of each of the support members are such that the support members provide a biasing force on the human being's occipital and mastoid bones during use of the neck rest, wherein the neck rest further comprises a holding mechanism for maintaining the support members in a bent position, the holding mechanism being adapted to be in a locked state, in which a selected bending of the support members is maintained, and in a released state, in which the support members are allowed to restore a non-bent shape, wherein the holding mechanism comprises at least one strap arranged along each of the support members, and at least one releasable locking member mounted on each strap, and being adapted to releasably hold the strap(s) in a selected position, wherein each releasable locking member is adapted to squeeze a portion of the corresponding strap, thereby preventing movements of the strap relative to the locking member, when the locking member is in a locking position, wherein the strap is allowed to move relative to the locking member when the locking member is in a released position, wherein each locking member comprises a biasing mechanism biasing the locking member towards its locking position, wherein each strap forms a loop which passes through a first noose arranged at a first position at one of the support members, and which passes through a second noose arranged at a second position at the support member, and wherein the position of the corresponding locking member, in its locking position, on the strap defines a distance between the first position and the second position, along the strap, the locking member thereby maintaining the support member in a bent position, defined by a difference between the distance between the first position and the second position along the support member, and the distance between the first position and the second position along the strap.

4. A neck rest according to claim 3, wherein the support members are fixedly attached to the intermediate section.

* * * * *